US008037650B2

(12) United States Patent
Reichert

(10) Patent No.: US 8,037,650 B2
(45) Date of Patent: Oct. 18, 2011

(54) MUNTIN CLIP

(75) Inventor: Gerhard Reichert, New Philadelphia, OH (US)

(73) Assignee: Edgetech I.G., Inc., Cambridge, OH (US)

( * ) Notice: Subject to any disclaimer, the term of this patent is extended or adjusted under 35 U.S.C. 154(b) by 0 days.

(21) Appl. No.: 12/755,214

(22) Filed: Apr. 6, 2010

(65) Prior Publication Data

US 2010/0186323 A1 Jul. 29, 2010

Related U.S. Application Data

(62) Division of application No. 11/267,824, filed on Nov. 3, 2005, now Pat. No. 7,716,885.

(60) Provisional application No. 60/625,041, filed on Nov. 3, 2004.

(51) Int. Cl.
*E06B 3/964* (2006.01)

(52) U.S. Cl. ..... 52/204.61; 52/314; 52/663; 52/741.1; 49/501; 49/506

(58) Field of Classification Search ..... 52/314, 52/311.3, 663, 664, 656.8, 204.61, 204.59, 52/844, 855, 204.5, 204.593, 204.6, 741.1, 52/745.19; 49/501, 506; 29/407.09, 407.1, 29/428, 525.01
See application file for complete search history.

(56) References Cited

U.S. PATENT DOCUMENTS

| | | | | | |
|---|---|---|---|---|---|
| 4,989,384 | A * | 2/1991 | Kinghorn et al. | ..... | 52/456 |
| 5,099,626 | A * | 3/1992 | Seeger | ..... | 52/314 |
| D350,064 | S * | 8/1994 | Crawley | ..... | D8/382 |
| 5,657,590 | A * | 8/1997 | Digman et al. | ..... | 52/204.61 |
| 5,678,376 | A * | 10/1997 | Poma | ..... | 52/656.8 |
| 5,678,377 | A * | 10/1997 | Leopold | ..... | 52/656.9 |
| 5,899,033 | A * | 5/1999 | Merchlewitz | ..... | 52/204.61 |
| 6,131,356 | A * | 10/2000 | Gieseke | ..... | 52/656.5 |
| 6,244,012 | B1 * | 6/2001 | McGlinchy et al. | ..... | 52/665 |
| 6,345,485 | B1 * | 2/2002 | Boone et al. | ..... | 52/786.13 |
| 6,425,221 | B1 * | 7/2002 | Reichert | ..... | 52/456 |
| 6,494,002 | B1 * | 12/2002 | Gieseke | ..... | 52/204.61 |
| 6,868,596 | B2 * | 3/2005 | Reichert | ..... | 29/407.05 |
| 6,935,078 | B1 * | 8/2005 | Benkel | ..... | 52/204.69 |
| 7,124,546 | B2 * | 10/2006 | Scharff et al. | ..... | 52/314 |
| 7,685,782 | B2 * | 3/2010 | Pettit et al. | ..... | 52/204.61 |
| 7,716,885 | B2 * | 5/2010 | Reichert | ..... | 52/204.61 |
| 2004/0076815 | A1 * | 4/2004 | Reichert | ..... | 428/317.1 |

OTHER PUBLICATIONS

Dec. 4, 2009, First Office Action in related Chinese Patent Application 200580037333.0.

Dec. 17, 2010, Second Office Action in related Chinese Patent Application 200580037333.0.

Feb. 3, 2011, First Office Action is related European Patent Application 05 817 497.0-1255.

* cited by examiner

*Primary Examiner* — Brian Glessner
*Assistant Examiner* — Joshua Ihezie
(74) *Attorney, Agent, or Firm* — Zollinger & Burleson Ltd.

(57) ABSTRACT

A muntin clip supports a muntin grid inside an insulating glazing unit. The clip includes a positioning arm that allows the clip to be positioned with respect to the spacer. In one embodiment, the clip has a flat base adapted to be positioned on the inwardly facing surface of the spacer. The positioning arm extends from one side of the plate with the muntin-engaging body extending from the other side of the plate. The arm has an outer end that projects beyond the outer edge of the plate. A method for using the clip includes the step of using one of the glass sheets to engage and position the positioning arm of the muntin clip. Stops may be provided to limit the insertion of the clip into the spacer.

11 Claims, 8 Drawing Sheets

MUNTIN CLIP

CROSS REFERENCE TO RELATED APPLICATIONS

This application is a divisional application claiming priority to U.S. patent application Ser. No. 11/267,824, filed Nov. 3, 2005, now U.S. Pat. No. 7,716,885 which claims the benefit of U.S. Provisional application Ser. No. 60/625,041 filed Nov. 3, 2004; the disclosures of both are incorporated herein by reference.

BACKGROUND OF THE INVENTION

1. Technical Field

The present invention generally relates to insulating glazing units and methods for assembling the glazing units. More particularly, the invention relates to the structure of muntin clips and methods of using muntin clips during the assembly of the insulating glazing unit. Specifically, the present invention relates to a muntin clip and a method of using the muntin clip wherein the muntin clip has a positioning arm that may be used to position the muntin clip and muntin grid with respect to a spacer during the assembly of an insulating glazing unit.

2. Background Information

Muntin clips are used to support and position muntin grids with respect to insulating glazing units. The muntin clips typically attach to or around the spacer that supports and spaces the glass sheets of the glazing unit. The muntin clips are typically disposed between the glass sheets to support a muntin grid between the glass sheets. These muntin grids created the appearance of a traditional divided lite window.

One type of spacer known in the art is a foam-bodied spacer such as the exemplary spacers disclosed in U.S. Pat. No. 4,831,799. Muntin clips have been connected to these types of spaces by sliding or pushing a portion of the muntin clip into a slit formed in the spacer. A drawback with this installation method is that each clip must be manually centered with respect to the spacer to properly align the muntin grid within the glazing unit. Aligning these types of muntin clips consumes valuable manufacturing time. Manufacturers who use highly efficient automated equipment to assemble glazing units desire an improved muntin clip that reduces or eliminates the step of manually aligning the muntin clips with respect to spacers.

SUMMARY OF THE INVENTION

The invention provides a muntin clip for supporting a muntin bar inside the insulating chamber of an insulated glazing unit having a perimeter spacer. The muntin clip includes a body adapted to be connected to a muntin bar; the body having an outer perimeter edge; and a positioning arm connected to the body and extending across the outer perimeter edge of the body; the positioning arm having an outer end disposed beyond the outer perimeter edge of the body wherein the positioning arm is adapted to be manipulated to move the body of the muntin clip with respect to the spacer.

In one configuration, the invention provides a muntin clip for supporting a muntin bar inside the insulating chamber of an insulated glazing unit having a perimeter spacer; the muntin clip including: a body adapted to be connected to a muntin bar; the body having a spacer-facing side that defines an outer perimeter edge; a positioning arm extending from the spacer-facing side of the body; the positioning arm being in the form of a flat plate having an inner end, an outer end, an upper edge and a lower edge; the positioning arm extending across the outer perimeter edge of the spacer-facing side of the body; the upper edge of the arm being connected to the spacer-facing side of the body; the arm having a first width at the upper edge of the arm; and the first width being substantially less than the distance between the upper and lower edges.

The invention also provides an insulating glazing unit that includes first and second glass sheets spaced apart by a perimeter spacer; each section of the spacer having a longitudinal direction parallel to the glass sheets; the spacer having a body defining a slit disposed transverse to the longitudinal direction of the spacer; a muntin bar disposed between the glass sheets; a muntin clip having a body adapted to engage the muntin bar; the body of the muntin clip having an outer perimeter edge; and the muntin clip having a positioning arm disposed in the slit of the spacer body; the positioning arm extending across the outer perimeter edge of the body.

The invention also provides a method for assembling an insulating glazing unit having a muntin grid; the method including the steps of: providing first and second sheets of glass; providing a spacer; connecting the spacer to the second sheet of glass to define the boundaries of an insulating chamber; providing a muntin grid having at least two leg ends to be connected to the spacer; providing a muntin clip for each leg end of the muntin grid; each of the muntin clips having a positioning arm; each positing arm having an inner end and an outer end; connecting one muntin clip to each leg end of the muntin grid with the positioning arms projecting in the same direction; supporting the muntin grid on the spacer with the inner ends of the positioning arms engaging the spacer and the outer ends of the positioning arms projecting from the spacer; engaging the first sheet of glass with the positioning arms of the muntin clips to move the muntin clip with respect to the spacer; and connecting the first sheet of glass to the spacer.

The invention also proves a method of locating a muntin clip with respect to a spacer; the method including the steps of: providing a spacer defining a slit; providing a muntin clip having a positioning arm; positioning a portion of the positioning arm in the slit of the spacer with at least a portion of the arm protruding from the spacer; and engaging the positioning arm to move the positioning arm and the muntin clip with respect to the spacer.

The different configurations of the invention described below may be used alone or in combination.

BRIEF DESCRIPTION OF THE DRAWINGS

The drawings are not to scale. Similar numbers refer to similar parts throughout the specification.

DETAILED DESCRIPTION OF THE INVENTION

Figure 1:
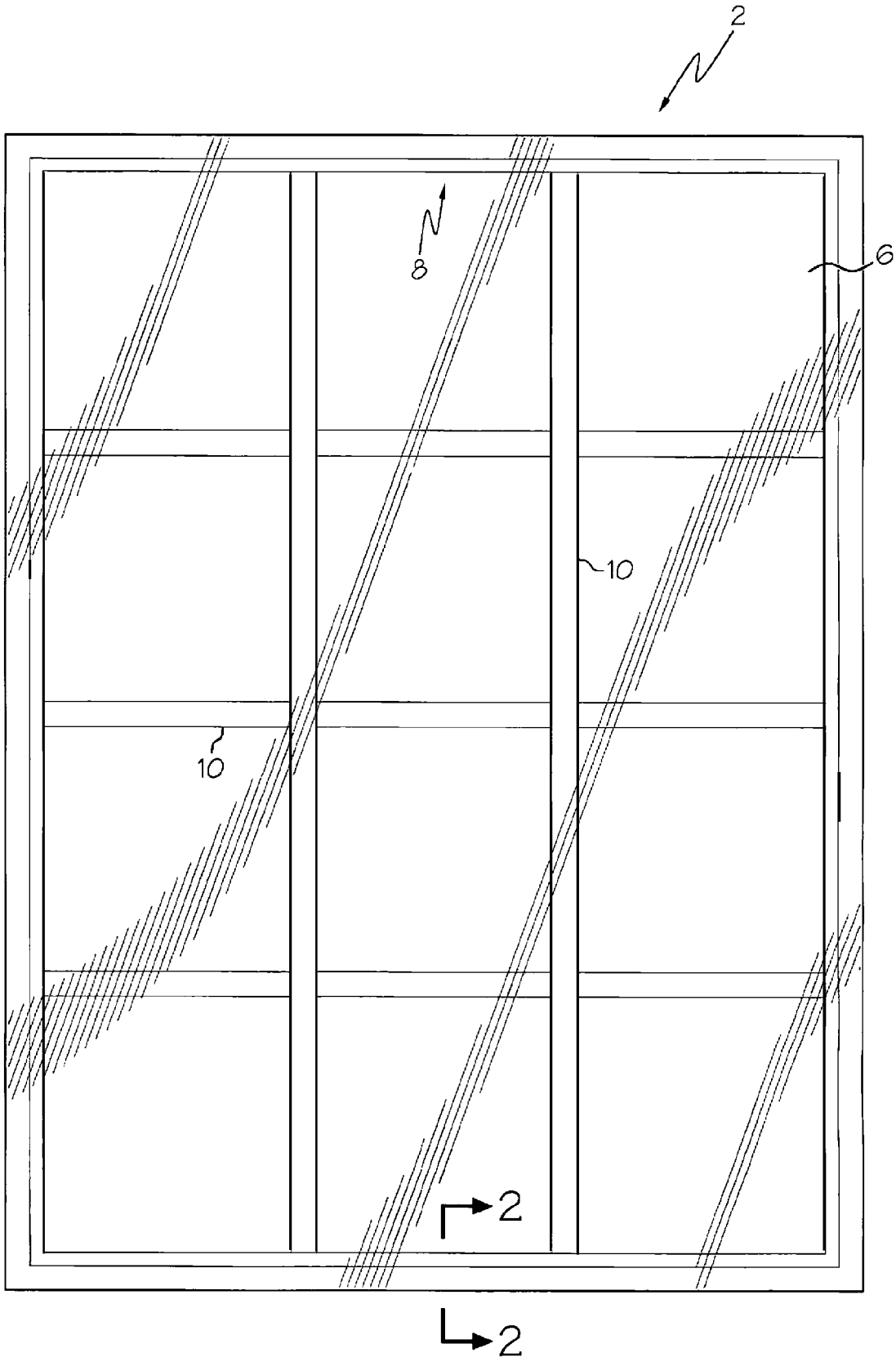
FIG. 1 is a front elevation view of an insulating glazing unit with a muntin grid disposed between the inner and outer sheets of glass.
Figure 2:
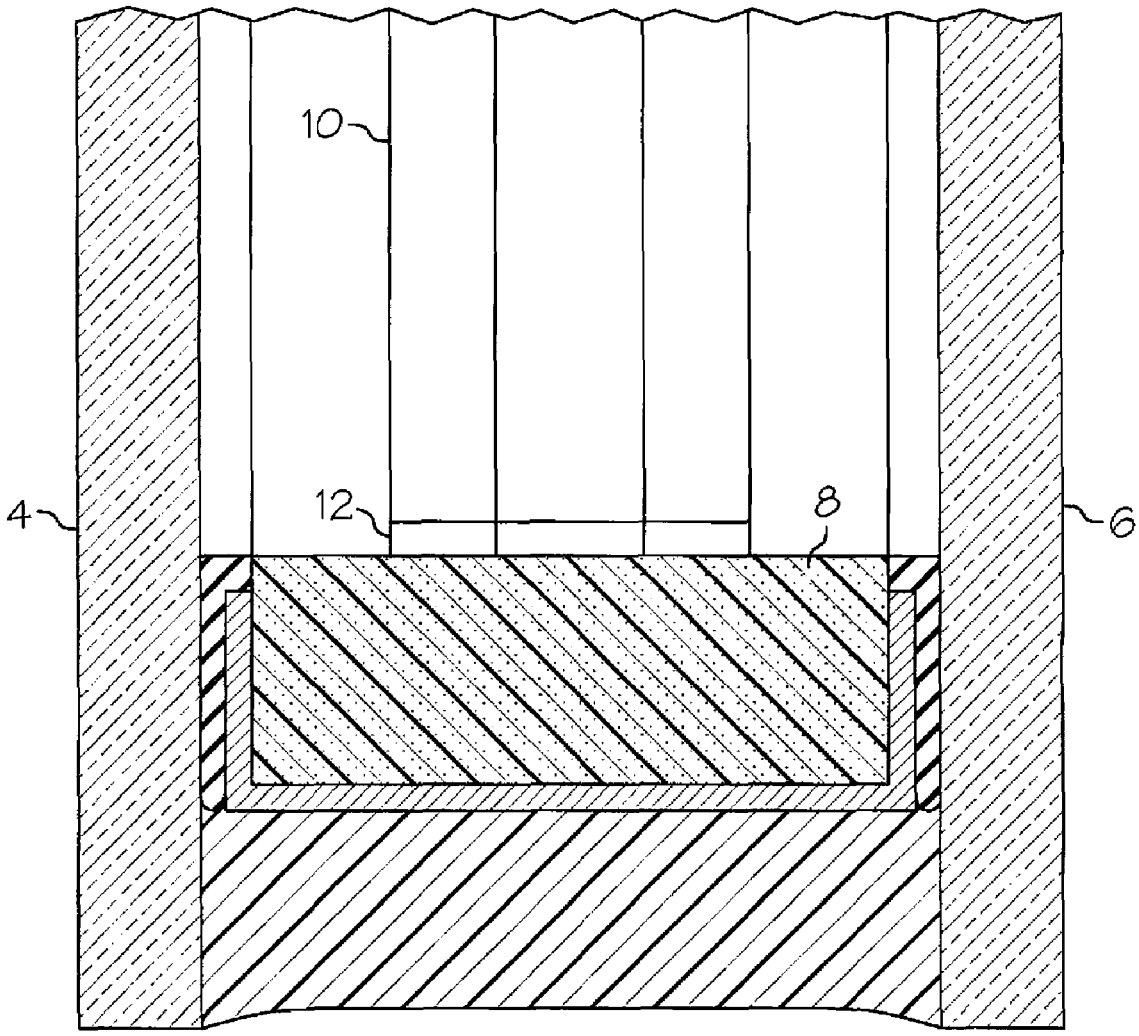
FIG. 2 is a section view of the spacer showing how the muntin clip is anchored in the spacer material.
Figure 4:
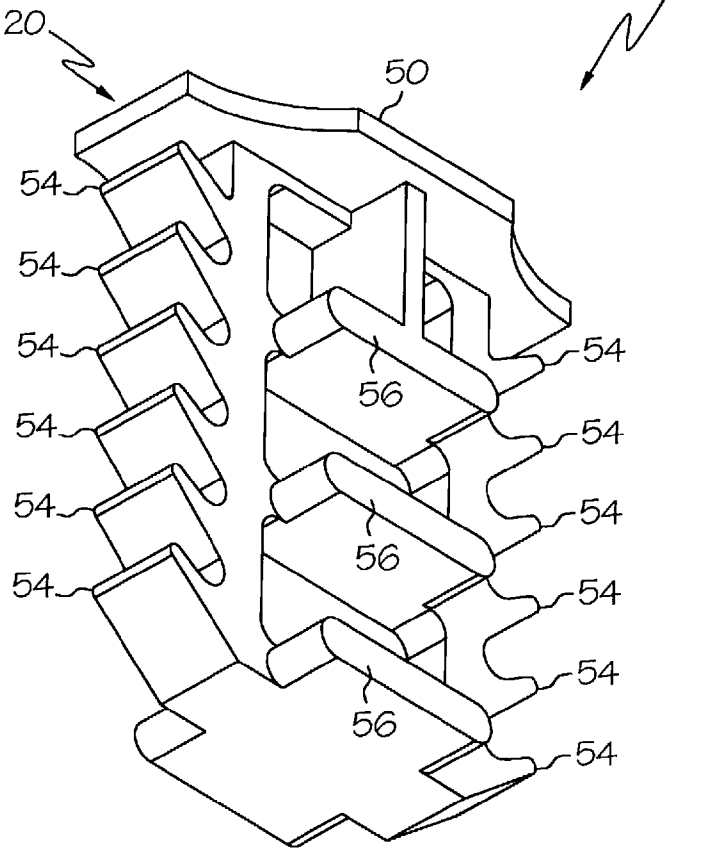
FIG. 4 is a second perspective view of the muntin clip of the invention.
Figure 3:
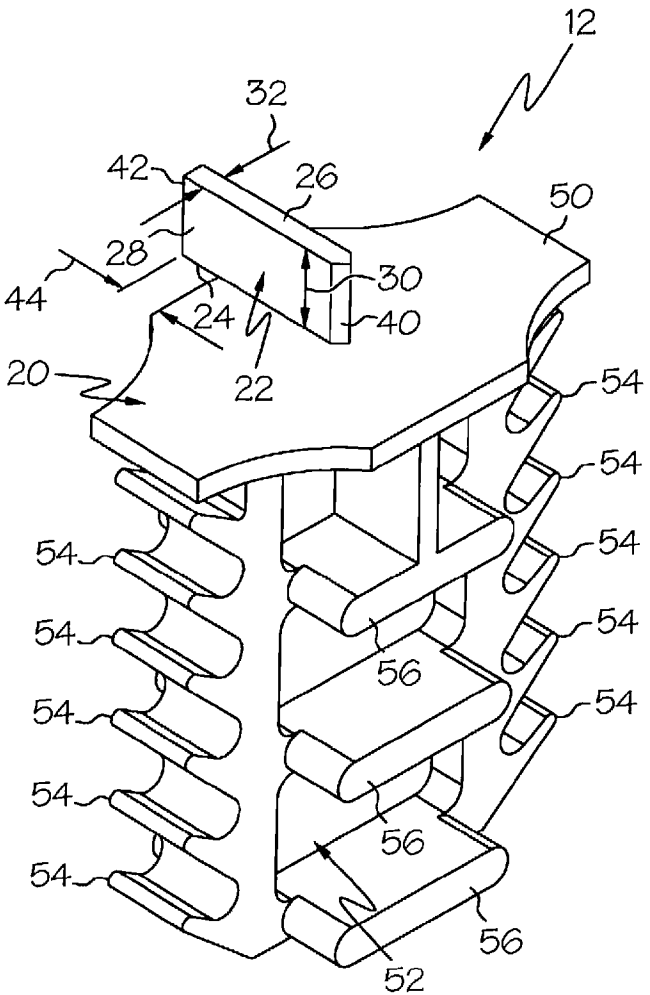
FIG. 3 is a first perspective view of the muntin clip of the invention.

An exemplary insulating glazing unit 2 is shown in FIG. 1. Unit 2 includes first 4 and second 6 sheets of glass supported and spaced apart by a perimeter spacer 8 that is inset from the outer perimeter edge of glass sheets 4 and 6 to define a sealant channel. Unit 2 also includes a muntin grid 10 disposed in the insulating chamber of the glazing unit. Muntin grid 10 is connected to spacer 8 with a plurality of muntin clips 12. Any of a variety of known spacers 8 may be used with clips 12 of the invention. In the exemplary drawings, a foam-bodied spacer 8 such as those disclosed in U.S. Pat. No. 4,831,799 is used to provide an exemplary disclosure of the invention. Clip 12 may also be used with different types of spacers 8 (metal, plastic, vinyl, foam, sealant-based) that may be slit so that clip 12 will function in the manner described below. Clip 12 also may be used with spacers 8 having deformable layers that allow clip 12 to be pushed into the deformable layer (such as a butyl sealant) to form its own slit as the clip is pushed into place as described below.

Figure 11:
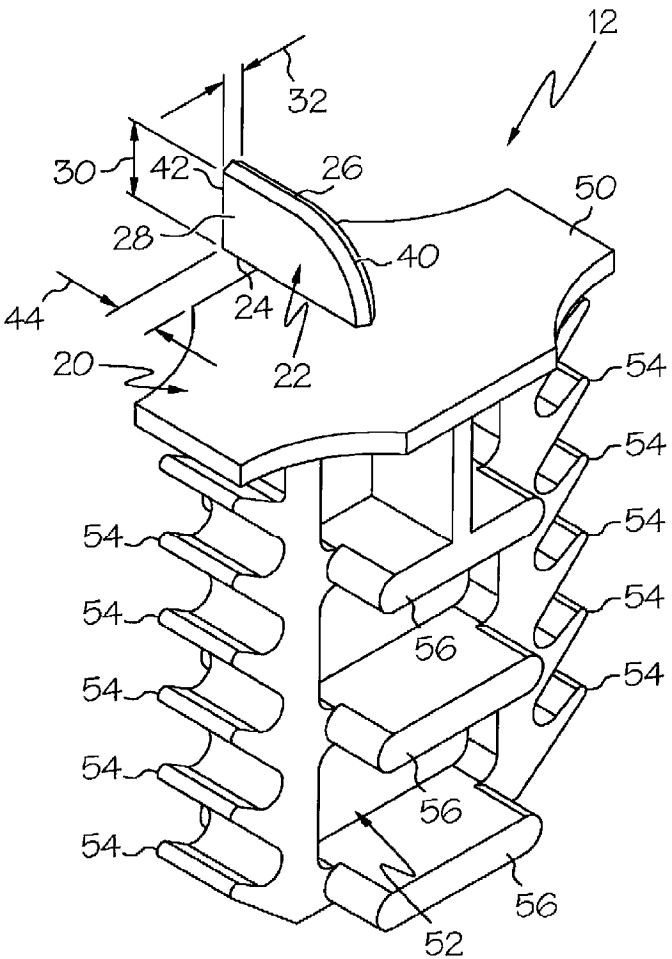
FIG. 11 is a perspective view showing a further configuration of the muntin clip of the invention.

Muntin clip 12 generally includes a body 20 and a positioning arm 22 that is connected to and extends from the spacer-facing surface of body 20 beyond the outer perimeter edge of body 20. The muntin-engaging portion of body 20 may be provided in a wide variety of geometric configurations. The specific configuration of body 20 is not important to this invention. Positioning arm 22 may be provided in the form of a thin plate or blade having an upper edge 24 connected to body 20, a lower edge 26 spaced from upper edge 24 by a pair of opposed walls 28. The width 30 of walls 28 is substantially greater than the width 32 of edge 26. In the exemplary configuration, width 32 is about 1 mm while width 30 is about 3 mm. Arm 22 further includes an inner end 40 disposed adjacent body 20 and an outer end 42 that protrudes from the outer perimeter of body 20. Inner end 40 is optionally tapered to a point. Lower edge 26 also may be tapered as shown in the alternative configuration of FIG. 11. FIG. 11 also depicts an alternative configuration having a curved leading edge for arm 22. In the exemplary configuration, outer end 42 extends 1 mm to 4 mm past the outer perimeter edge of body 20 as indicated by dimension line 44. Arm 22 also may be provided in the form of a small-diameter bar, rod, or pin adapted to slide within slits 60 described below. These structures may be formed to have an L-shaped or sinusoidal shaped configuration. They may also have an inherent resilient spring-like force.

In the exemplary configuration, body 20 includes a generally flat base 50 with arm 22 being connected to the spacer-facing side and a grid-engaging structure (I-beam shaped in the drawings) 52 extending from the other side. In the exemplary configuration, the side of flat base 50 having arm 22 is flat and smooth with arm 22 centered on base 50. Base 50 may have an outer perimeter that matches the cross sectional shape of a muntin bar from grid 10. Base 50 may also be smaller than the muntin bar cross section so that no portion of base 50 is visible when clip 12 is in use. A plurality of resilient fingers 54 extend toward base from the opposed ends of structure 52. Fixed fingers 56 extend outwardly from the web of structure 52. Fingers 54 and 56 are sized and configured to engage the inner surface of the end of one piece of muntin grid 10 to secure clip 12 to grid 10. Any of a wide variety of finger configurations may be used with clip 12 and the invention is not to be limited by the configuration of grid-engaging structure 52.

Clips 12 are used to support muntin grid 10 from spacer 8. Clips 12 also may be used to properly position muntin grid 10 during the assembly of glazing unit 2. In one configuration of the method, one sheet of glass 4 contacts outer ends 42 of arms 22 to move clips 12 (and thus grid 10) with respect to spacer 8. The glass/arm contact and movement occurs during the manufacture of unit 2 when glass sheet 4 is brought into engagement with spacer 8. In another configuration, arms 22 may be pushed into position by the mechanism (automated arm or human worker) that places muntin grid 10 onto spacer 8.

Figure 9:
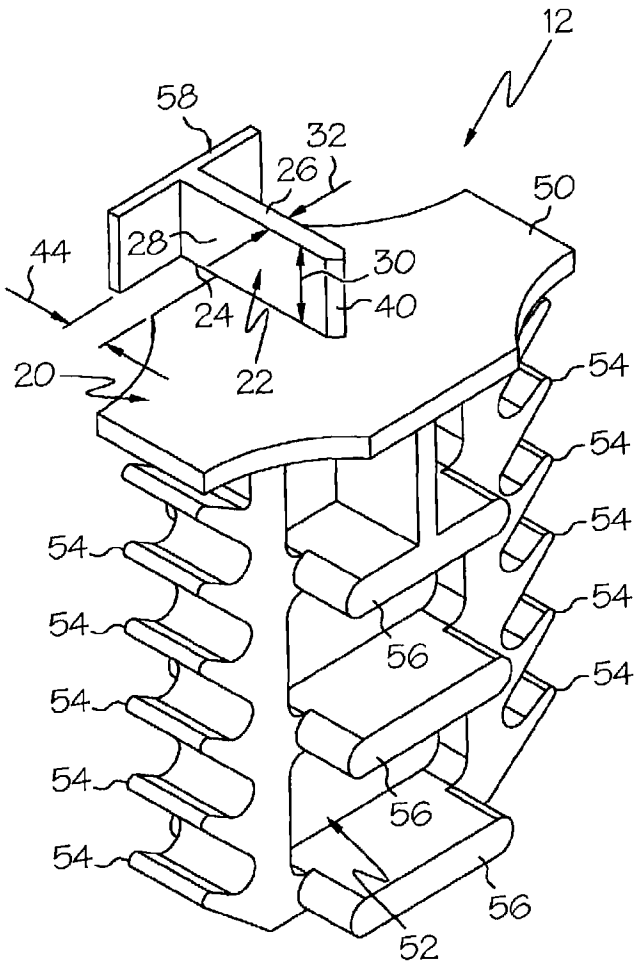
FIG. 9 is a perspective view showing another configuration of a stop used to limit the movement of the muntin clip.
Figure 8:
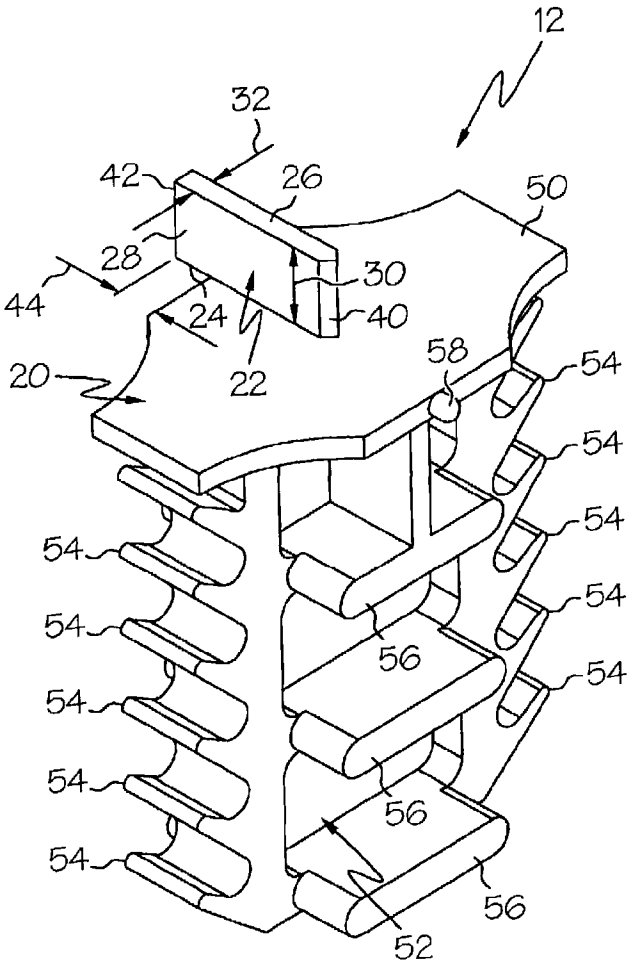
FIG. 8 is a perspective view showing one configuration of a stop used to limit the movement of the muntin clip.
Figure 10:
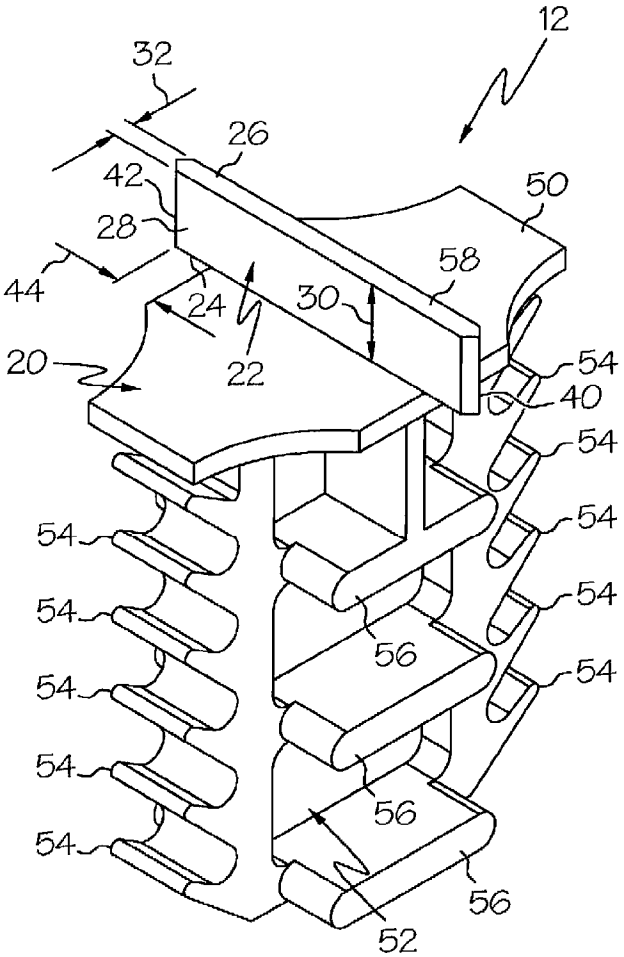
FIG. 10 is a perspective view showing a further configuration of a stop used to limit the movement of the muntin clip.

Additional alternative configurations of clips 12 are shown in FIGS. 8-10. Each of the alternative configurations includes a stop 58 that, in certain circumstances, limits the position of clip 12 with respect to spacer 8. In FIG. 8, stop 58 is in the form of a finger that projects from base 50 in a direction opposite from the protruding direction of arm 22. Stop 58 is disposed in the same plane as base 50 so that it is disposed above spacer 8 when clip is installed. Stop 58 will engage the inner surface of glass 6 if clip 12 is pushed too far across spacer 12. Stop 58 has a small rounded end so that any coating on the inner surface of glass 4 is not disturbed. The length of finger 58 may be configured to coordinate with the width of spacer 8 so that finger 58 will not engage glass 6 at an undesirable location of clip 12. In FIG. 9, stop 58 is in the form of a finger that projects perpendicularly from outer end 42. This configuration of stop 58 engages the edge of spacer 8 adjacent glass 4 to prevent clip 12 from being pushed into spacer 8 too far. In this configuration, stop 58 should be thin to minimize any interference to the bond between spacer 8 and glass 4. In FIG. 10, stop 58 is in the form of an arm similar to arm 22 except that stop 58 projects in the opposite direction. The length of this stop 58 also may be configured to coordinate with the width of spacer 8.

In the exemplary methods, spacer 8 is attached to one glass sheet 6 to form a perimeter spacer and to define the boundaries of an insulating chamber. In some configurations, slits 60 are formed in spacer 8 such that each slit 60 faces inwardly toward the insulating chamber. Slits 60 are located where the ends of grid 10 will be supported by spacer 8. Slits 60 may be formed in spacer 8 before or after spacer 8 is attached to glass 4. For the purpose of providing an example, if the spacer height (right to left direction in FIG. 5A) is X, then the depth of slit 60 may be two-thirds X and the depth of arm 22 (from edge 24 to edge 26) may be half X.

In other embodiments of the invention, spacer 8 is marked with an indicator showing where clip 12 will be attached to spacer 8. The indicator may be marked directly on the material of spacer 8, may be projected onto spacer 8, or may be disposed adjacent spacer 8 such that the indicators are in visual alignment with spacer 8. With these indicators, a user can push clips 12 into place at the location of the indicators or may form the slits with a cutter before inserting grid 10.

Figure 5:
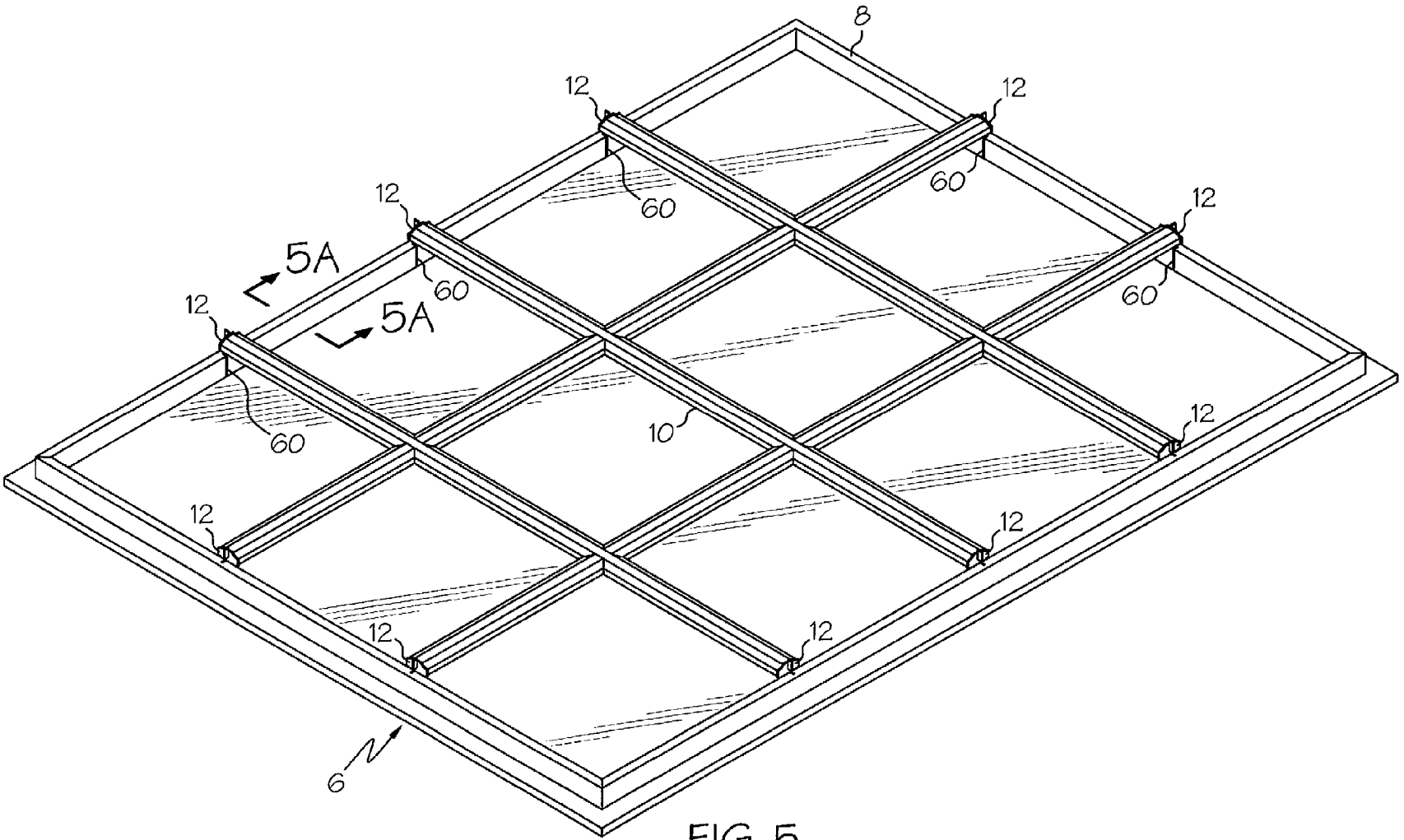
FIG. 5 is a perspective view of an assembly step of the insulating glazing unit manufacturing process wherein the spacer has been attached to one of the glass sheets and the muntin grid is assembled and aligned with the slits in the spacer.
Figure 6:
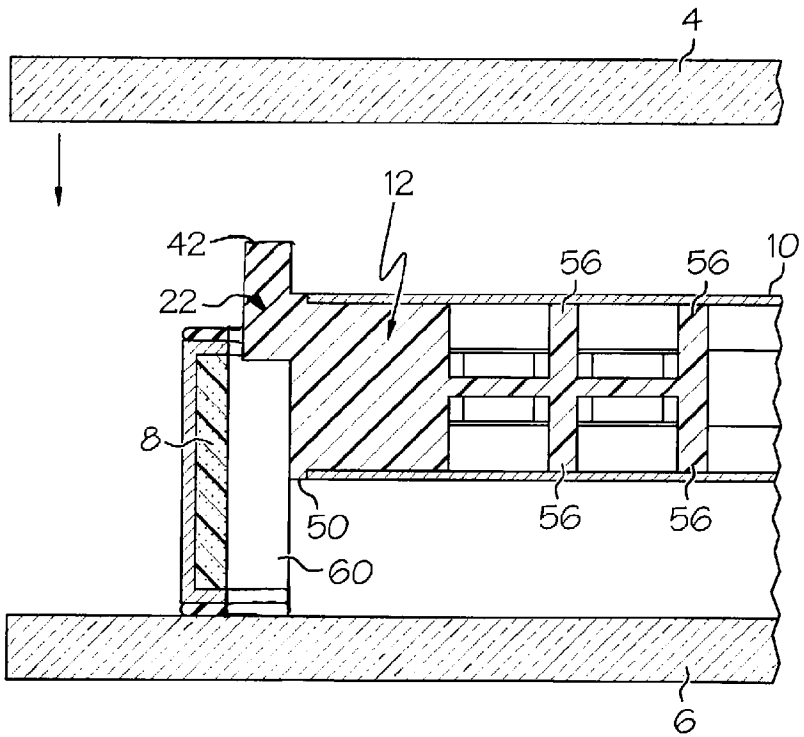
FIG. 6 is a section view taken through one of the slits showing the initial position of the muntin clip with respect to the spacer.
Figure 5A:
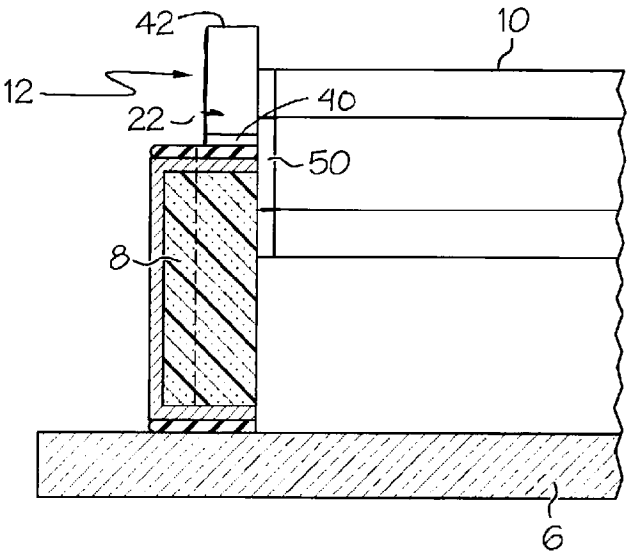
FIG. 5A is a section view taken along line 5A-5A of FIG. 5.
Figure 7:
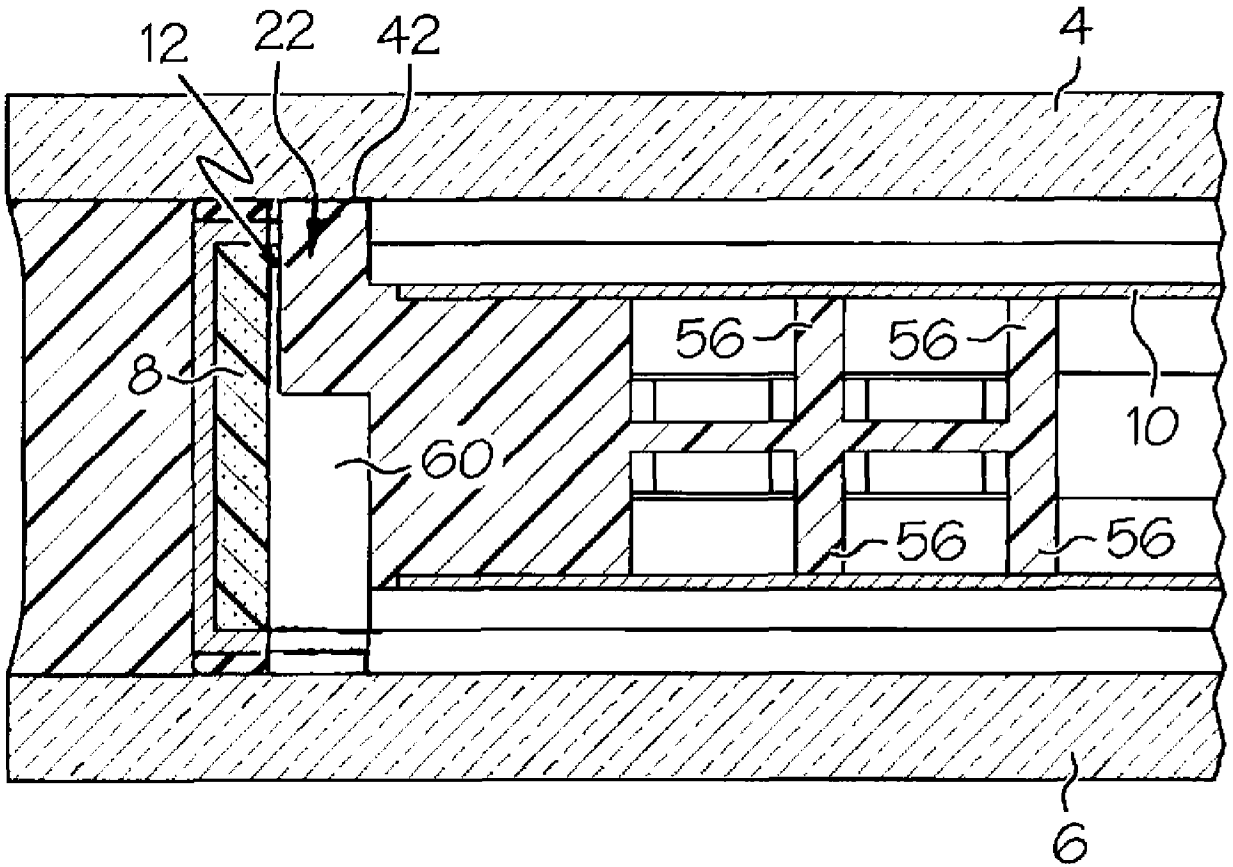
FIG. 7 is a section view similar to FIG. 6 showing the second sheet of glass engaging and positioning the muntin clip with respect to the spacer.

In one configuration, muntin grid 10 is assembled with clip 12 positioned in each leg end of grid 10. Clips 12 are oriented with arms 22 projecting from the same side of grid 10. In a separate operation, spacer 8 is attached to glass sheet 6 in a manner that allows spacer 8 to be ready to receive grid 10. For example, spacer 8 may be attached to glass sheet 6 with an adhesive. Glass 6 and spacer 8 may be in either a horizontal or vertical configuration (inclusive of angular positions between). Grid 10 is then placed onto spacer 8 with the inner ends 40 of clips 12 resting against spacer 8 as shown in FIGS. 5 and 5A. With inner ends 40 resting on spacer 8, the flat spacer-side of base 50 is partially disposed over the inwardly-facing surface of spacer 8 (FIG. 5A). Resting grid 10 on spacer 8 in this manner is especially desirable with large grids 10. Once grid 10 is resting in place on clips 12, the user may go from leg to leg of grid 10 to insert a portion of each positioning arm 22 into its corresponding slit 60 such that outer end 42 of arm 22 protrudes from spacer 8. The process of inserting each arm 22 into slit 60 is aided by the fact that grid 10 is supported with each clip 12 in the approximate area of its slit 60. After all of clips 12 are at least partially positioned in slits 60, second sheet of glass 4 is attached to spacer 8 to form unit 2 (FIGS. 6 and 7). When this occurs, the second sheet 4 of glass pushes arms 22 into spacer 8 to evenly position all clips 12 with respect to spacer 8. In some applications, the assembly is subjected to pressure that compresses spacer 8. In some applications, spacer 8 is compressed up to 1 mm. When this compression occurs, arms 22 are pushed into the body of spacer 8 such that outer ends 42 are hidden from view when spacer 8 expands back from the collapsed position. This method uniformly positions clips 12 with respect to spacer 8 by using the step of adding glass sheet 4 to spacer 8.

Alternative methods use the same steps described above but use a different mechanism to push outer ends 42 of positioning arms 22 in place. The alternative mechanism may be the worker (hand, finger, or hand-held tool) who places grid 10 onto spacer 8. In this alternative, arms 22 allow the user to properly align each clip 12 with spacer 8 by preventing clip 12 from being pushed too far into spacer 8. The mechanism for pushing arm 22 also may be a portion of automated equipment that automatically loads grid 10 onto spacer. A further alternative method does not use preformed slits 60. In this method, arms 22 are sharp enough to cut into the material of spacer 8 when clips 12 are pushed into position.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A muntin clip for supporting a muntin bar inside the insulating chamber of an insulating glazing unit having a perimeter spacer; the muntin clip comprising:

a body adapted to be connected to a muntin bar; the body having a spacer-facing side that defines an outer perimeter edge of the body;

a positioning arm extending directly from the spacer-facing side of the body; the entire positioning arm being in the form of a thin flat plate having an inner end, an outer end, a first edge and a second edge; the thin flat plate being adapted to be disposed in a slit defined by a spacer;

the positioning arm extending across the outer perimeter edge of the spacer-facing side of the body;

the first edge of the positioning arm being directly connected to the spacer-facing side of the body; the first edge of the positioning arm being disposed directly between the second edge of the positioning arm and the body of the muntin clip;

the positioning arm having a first width at the first edge of the positioning arm; and the first width being substantially less than the distance between the first and second edges.

2. The muntin clip of claim 1, wherein the inner end of the positioning arm is tapered to a point.

3. The muntin clip of claim 1, wherein the positioning arm defines a smoothly rounded corner between the inner end and the second edge.

4. The muntin clip of claim 1, further comprising a stop finger projecting from the body in a direction opposite from the projecting direction of the positioning arm.

5. The muntin clip of claim 1, wherein the positioning arm extends across the outer perimeter edge in two locations; the positioning arm projecting from opposite sides of the body.

6. The muntin clip of claim 1, wherein the positioning arm is centered with respect to the body.

7. The muntin clip of claim 1, wherein the second edge is spaced from the first edge by a pair of opposed walls.

8. The muntin clip of claim 7, wherein the width of the walls is substantially greater than the widths of the edges.

9. The muntin clip of claim 8, wherein the width of the edges is 1 mm and the width of the walls is 3 mm.

10. A muntin clip for supporting a muntin bar inside the insulating chamber of an insulating glazing unit having a perimeter spacer; the muntin clip comprising:

a body adapted to be connected to a muntin bar; the body having a spacer-facing side that defines an outer perimeter edge;

a positioning arm extending from the spacer-facing side of the body; the positioning arm being in the form of a thin flat plate having an inner end, an outer end, an upper edge and a lower edge; the thin-flat plate being adapted to be disposed in a slit defined by a spacer;

the positioning arm extending across the outer perimeter edge of the spacer-facing side of the body;

the upper edge of the positioning arm being connected to the spacer-facing side of the body;

the positioning arm having a first width at the upper edge of the positioning arm;

the first width being substantially less than the distance between the upper and lower edges; and a stop connected to the outer end of the positioning arm.

11. A muntin clip for supporting a muntin bar inside the insulating chamber of an insulating glazing unit having a perimeter spacer; the muntin clip comprising:

a body adapted to be connected to a muntin bar; the body having a base that defines a spacer-facing side that defines an outer perimeter edge;

a positioning arm extending from the spacer-facing side of the body; the positioning arm being in the form of a thin flat plate having an inner end and an outer end;

the inner end of the positioning arm being disposed within the outer perimeter edge of the spacer-facing side of the base;

the outer end of the positioning arm being disposed outwardly of the outer perimeter edge of the spacer-facing side of the base;

the positioning arm further having an upper edge and a lower edge;

the upper edge of the positioning arm being connected to the spacer-facing side of the body;

the positioning arm having a first width at the upper edge of the positioning arm; and the first width being substantially less than the distance between the upper and lower edges;

the inner end of the positioning arm being centered with respect to the body; and a stop connected to the outer end of the positioning arm.

* * * * *